US009301628B1

(12) United States Patent
Allen

(10) Patent No.: US 9,301,628 B1
(45) **Date of Patent: *Apr. 5, 2016**

(54) SHOPPING CART CORRAL FOR DISPLAYING ONE OR MORE ADVERTISEMENTS AND METHOD OF PROVIDING SAME

(71) Applicant: Starlite Media, LLC, New York, NY (US)

(72) Inventor: Joseph Allen, Murrieta, CA (US)

(73) Assignee: Starlite Media, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/609,130

(22) Filed: Jan. 29, 2015

Related U.S. Application Data

(63) Continuation of application No. 14/341,318, filed on Jul. 25, 2014, now Pat. No. 9,138,081, which is a continuation of application No. 13/864,636, filed on Apr. 17, 2013, now Pat. No. 8,820,542, which is a (Continued)

(51) Int. Cl.
*A47F 10/04* (2006.01)
*G09F 19/00* (2006.01)

(52) U.S. Cl.
CPC ..... *A47F 10/04* (2013.01); *G09F 19/00* (2013.01)

(58) Field of Classification Search
CPC ..... A47F 10/14; G09F 21/04; G09F 15/0012; G09F 15/0018; G09F 15/0037; G09F 21/00; G09F 19/00
USPC ..... 52/33, 36.2; 211/17; D20/19, 39, 41; 40/606.03, 607.03, 591, 624; 3/33, 3/36.2
See application file for complete search history.

(56) References Cited

U.S. PATENT DOCUMENTS

| | | | |
|---|---|---|---|
| D31,832 | S | 11/1899 | Marcus |
| 1,927,997 | A | 9/1933 | Weston |
| 2,165,724 | A | 7/1939 | Le |
| 2,985,316 | A | 5/1961 | Ruhnke |
| 3,323,655 | A | 6/1967 | Foran et al. |

(Continued)

FOREIGN PATENT DOCUMENTS

| | | |
|---|---|---|
| CA | 2848905 | 3/2013 |
| CN | 203054922 | 7/2013 |
| EP | 2273444 | 1/2011 |
| EP | 2487875 | 8/2012 |
| WO | WO 2013/040591 | 3/2013 |
| WO | WO 2013/126894 | 8/2013 |

OTHER PUBLICATIONS

RFID Technology [online], [retrieved Feb. 14, 2013]. Retrieved from the Internet: <URL: http://www.vorelco.com/services/rfid-technology>, 16 pages.

(Continued)

*Primary Examiner* — Ryan Kwiecinski
*Assistant Examiner* — Alp Akbasli
(74) *Attorney, Agent, or Firm* — Bryan Cave LLP

(57) ABSTRACT

Some embodiments disclose a corral configured to hold one or more shopping carts and display one or more advertisements. The corral can include: (a) an enclosure having an opening configured to receive the one or more shopping carts, the enclosure having a first side; and (b) at least one first panel located at the first side and configured to display at least a first advertisement of the one or more advertisements. The advertising panels can be configured to be coupled adjacent the opening of the corral to facilitate better visibility.

20 Claims, 12 Drawing Sheets

Related U.S. Application Data continuation of application No. 13/533,766, filed on Jun. 26, 2012, now Pat. No. 8,424,690, which is a continuation of application No. 12/456,875, filed on Jun. 24, 2009, now Pat. No. 8,205,757.

(56) References Cited

U.S. PATENT DOCUMENTS

| | | | | |
|---|---|---|---|---|
| D219,946 | S | 2/1971 | Birnberg | |
| 3,722,702 | A | 3/1973 | Marker, Jr. | |
| 4,236,697 | A | 12/1980 | Savino | |
| 4,292,352 | A | 9/1981 | Singer | |
| 4,364,192 | A | 12/1982 | Lloyd | |
| D269,978 | S * | 8/1983 | Dickson | D20/19 |
| 4,609,183 | A | 9/1986 | Ulmer | |
| D286,074 | S | 10/1986 | Corte | |
| 4,777,750 | A | 10/1988 | Garfinkle | |
| 4,884,353 | A | 12/1989 | Taylor | |
| 4,918,878 | A | 4/1990 | Paschke et al. | |
| 4,957,256 | A | 9/1990 | Boeding | |
| D321,798 | S | 11/1991 | Buckley | |
| 5,082,087 | A * | 1/1992 | Hubbell | 182/129 |
| D334,301 | S | 3/1993 | Buckley | |
| 5,201,426 | A | 4/1993 | Cruwell | |
| 5,220,740 | A | 6/1993 | Brault | |
| 5,279,085 | A | 1/1994 | DiPaolo et al. | |
| D350,038 | S | 8/1994 | Buckley | |
| D361,448 | S | 8/1995 | Buckley | |
| 5,551,578 | A * | 9/1996 | McCue et al. | 211/17 |
| D376,854 | S | 12/1996 | DiPaolo et al. | |
| 5,626,926 | A | 5/1997 | Roberts | |
| 5,708,782 | A * | 1/1998 | Larson et al. | 705/14.23 |
| 5,862,921 | A | 1/1999 | Venegas | |
| 5,875,578 | A * | 3/1999 | Grewe | 40/608 |
| 5,878,518 | A * | 3/1999 | Grewe | 40/606.02 |
| 6,298,997 | B1 * | 10/2001 | Jarrett et al. | 211/17 |
| 6,449,888 | B1 | 9/2002 | Gibbs | |
| 6,493,997 | B2 | 12/2002 | Cohen | |
| 6,581,616 | B1 | 6/2003 | Venegas | |
| D488,904 | S | 4/2004 | Unnerstall et al. | |
| D492,732 | S | 7/2004 | Herbst | |
| D495,011 | S | 8/2004 | Trubiano | |
| D497,167 | S | 10/2004 | Ozolins et al. | |
| 6,975,205 | B1 | 12/2005 | French et al. | |
| 7,044,446 | B2 | 5/2006 | Hempen et al. | |
| 7,140,581 | B1 | 11/2006 | White | |
| D537,952 | S * | 3/2007 | Anton | D25/18 |
| D540,472 | S * | 4/2007 | Van Es | D25/22 |
| 7,210,270 | B1 | 5/2007 | King et al | |
| 7,237,360 | B2 | 7/2007 | Moncho et al. | |
| 7,283,650 | B1 * | 10/2007 | Sharma et al. | 382/118 |
| D587,761 | S | 3/2009 | Grimshaw | |
| D588,201 | S | 3/2009 | Kohagen et al. | |
| 7,660,747 | B2 | 2/2010 | Brice et al. | |
| D615,129 | S * | 5/2010 | Allen | D20/19 |
| D620,531 | S * | 7/2010 | Allen | D20/19 |
| 7,894,936 | B2 * | 2/2011 | Walker et al. | 700/238 |
| 7,895,782 | B2 | 3/2011 | Farrell | |
| 8,015,737 | B2 | 9/2011 | Venegas, Jr. | |
| 8,104,671 | B2 | 1/2012 | Besecker et al. | |
| D653,709 | S * | 2/2012 | Allen | D20/39 |
| RE43,233 | E | 3/2012 | Venegas, Jr. | |
| 8,205,757 | B2 | 6/2012 | Allen | |
| D663,779 | S * | 7/2012 | Lueken | D20/19 |
| D667,504 | S * | 9/2012 | Allen | D20/19 |
| 8,332,272 | B2 | 12/2012 | Fisher | |
| 8,424,690 | B2 | 4/2013 | Allen | |
| D682,944 | S * | 5/2013 | Lueken | D20/19 |
| D695,835 | S | 12/2013 | Lueken | |
| D695,836 | S | 12/2013 | Lueken | |
| D695,837 | S | 12/2013 | Lueken | |
| D699,789 | S | 2/2014 | Allen | |
| D701,322 | S | 3/2014 | McCue et al. | |
| D703,271 | S | 4/2014 | Lueken | |
| D725,287 | S | 3/2015 | Allen | |
| 8,984,782 | B1 | 3/2015 | Lueken | |
| 2003/0115096 | A1 * | 6/2003 | Reynolds et al. | 705/14 |
| 2004/0079934 | A1 | 4/2004 | Hempen et al. | |
| 2004/0225560 | A1 | 11/2004 | Lewis et al. | |
| 2005/0083465 | A1 | 4/2005 | Niiyama et al. | |
| 2008/0040962 | A1 | 2/2008 | Gurren | |
| 2008/0120877 | A1 | 5/2008 | Farrell | |
| 2008/0185888 | A1 | 8/2008 | Beall et al. | |
| 2008/0262928 | A1 * | 10/2008 | Michaelis | 705/14 |
| 2009/0288012 | A1 | 11/2009 | Hertel et al. | |
| 2010/0114683 | A1 | 5/2010 | Wessels et al. | |
| 2010/0327245 | A1 * | 12/2010 | Allen | 256/25 |
| 2011/0047023 | A1 | 2/2011 | Lieblang et al. | |
| 2011/0185607 | A1 * | 8/2011 | Forster et al. | 40/452 |
| 2011/0218942 | A1 | 9/2011 | Scheffer | |
| 2012/0029998 | A1 | 2/2012 | Aversano et al. | |
| 2012/0066068 | A1 | 3/2012 | Pan | |
| 2012/0123826 | A1 | 5/2012 | French et al. | |
| 2012/0209686 | A1 | 8/2012 | Horowitz et al. | |
| 2012/0271715 | A1 | 10/2012 | Morton et al. | |
| 2013/0085835 | A1 | 4/2013 | Horowitz | |
| 2013/0090999 | A1 | 4/2013 | Lellouche | |
| 2013/0091002 | A1 | 4/2013 | Christie et al. | |
| 2013/0159090 | A1 | 6/2013 | Boal | |
| 2013/0204697 | A1 | 8/2013 | Boal | |
| 2013/0332253 | A1 | 12/2013 | Shiffert et al. | |
| 2013/0332258 | A1 | 12/2013 | Shiffert et al. | |
| 2013/0332274 | A1 | 12/2013 | Faith et al. | |
| 2013/0332283 | A1 | 12/2013 | Faith et al. | |
| 2014/0108108 | A1 | 4/2014 | Artman et al. | |

OTHER PUBLICATIONS

Thinaire Launches the First Ever NFC Enterprise Marketing Platform [online], Sep. 12, 2012, [retrieved Jul. 31, 2014]. Retrieved from the Internet <URL: http://globenewswire.com/news-release/2012/09/12/490308/10004878/en/Thinaire-TM-Launches-the-First-Ever-NFC-Enterprise-Marketing-Platform.html>.

Kraft NFC pilot delivers 12 times the engagement level of QR codes [online], Oct. 18, 2012, [retrieved Jul. 31, 2014]. Retrieved from the Internet <URL: http://www.mobilecommercedaily.com/kraft-nfc-pilot-delivers-12-times-the-engagement-level-of-qr-codes>.

Valassis Launches Electronic Coupon Clearing Platform [online], Oct. 20, 2011, [retrieved Jul. 31, 2014]. Retrieved from the Internet <URL: http://news.thomasnet.com/fullstory/Coupon-Redemption-Software-performs-real-time-validation-604347>.

RFID-Enabled Cart Set to Provide Shoppers with Product Info, Ads [online], Jan. 31, 2007, [retrieved Jul. 31, 2014]. Retrieved from the Internet <URL: http://rfidjournal.com/articles/view?3013>.

Meijer's Smart Carts [online], Nov. 8, 206, [retrieved Jul. 31, 2014]. Retrieved from the Internet <URL: http://www.retailwire.com/discussion/11786/meijers-smart-carts.

Store logistics and payment with NFC [online], Jul. 1, 2006, [retrieved Jul. 31, 2014]. Retrieved from the Internet <URL: http://www.ist-world.org/ProjectDetails.aspx?ProjectId=e89323fb585a4b798bf211f044c71b54&SourceDatabaseId=7cff9226e582440894200b751bab883f>.

Stop & Shop, Scan It! & Scan It! Mobile [online], [retrieved Aug. 1, 2014]. Retrieved from the Internet <URL: http://www.stopandshop.com/scanitmobile>.

Brand.net brochure, Mobile Ads: Any Device / Instant Action.

Stop and Shop, Login [online], [retrieved Aug. 1, 2014]. Retrieved from the Internet <URL: https://www.stopandshop.com/login/?_requestid=88655>.

Grabert, "Clear Channel Outdoor launches 'Connect,' the first global out-of-home mobile interactive advertising platform" [online], Mar. 25, 2014, [retrieved Aug. 19, 2015]. Retrieved from the Internet <http://company.clearchanneloutdoor.com/clear-channel-outdoor-launches-connect-first-global-home-mobile-interactive-advertising-platform>.

* cited by examiner

SHOPPING CART CORRAL FOR DISPLAYING ONE OR MORE ADVERTISEMENTS AND METHOD OF PROVIDING SAME

CROSS-REFERENCE TO RELATED APPLICATIONS

The present application is a continuation of U.S. application Ser. No. 14/341,318 which was filed on Jul. 25, 2014, which is continuation of U.S. application Ser. No. 13/864,636, which was filed on Apr. 17, 2013, now U.S. Pat. No. 8,820,542, which is a continuation of U.S. application Ser. No. 13/533,766, which was filed on Jun. 26, 2012, now U.S. Pat. No. 8,424,690, which is a continuation of U.S. application Ser. No. 12/456,875, which was filed on Jun. 24, 2009, now U.S. Pat. No. 8,205,757, the contents of which are incorporated by reference herein in their entireties.

FIELD OF THE INVENTION

This invention relates generally to corrals for shopping carts, and relates more particularly to such corrals configured to hold one or more shopping carts and display one or more advertisements and methods of providing the same.

DESCRIPTION OF THE BACKGROUND

Many stores provide shopping carts for their customers to allow the customers to transport merchandise in their stores and to their vehicles. Stores also provide shopping cart corrals in their parking lots so the store's customers can return the shopping carts after the customers have transported any purchased merchandise to their vehicles. Providing shopping cart corrals reduces vehicle damage complaints by customers by supplying the customers with a location to return their shopping carts, instead of the customers leaving the shopping carts in unoccupied parking spaces in the store's parking lot. Shopping carts left in unoccupied parking spaces are more likely to roll (or be accidentally pushed) into a vehicle parked in the parking lot and cause damage to the body or paint of the vehicle, as well as damage the cart. Shopping cart corrals, also, help keep parking lots organized and reduce shopping cart theft and loss.

While shopping cart corrals can save the store money by reducing shopping cart loss and claims of vehicle damage, shopping cart corrals are expensive to purchase and provide no direct revenue to the store.

Furthermore, shopping cart corrals can become dingy and battered after an extended period of time in the parking lot. Dingy and battered shopping cart corrals can be a blemish or eyesore at the front of an otherwise pristine and/or well-maintained store. Dingy shopping cart corrals are particularly problematic because they are often located in high traffic areas.

Accordingly, a need or potential for benefit exists for a shopping cart corral that provides on-going revenue to the store, that is more attractive, and that is not a blemish or eyesore. A need also exists to better utilize the valuable space occupied by shopping cart corrals to reach out to people driving or walking through parking lots.

BRIEF DESCRIPTION OF THE DRAWINGS

To facilitate further description of the embodiments, the following drawings are provided in which.

Figure 1:
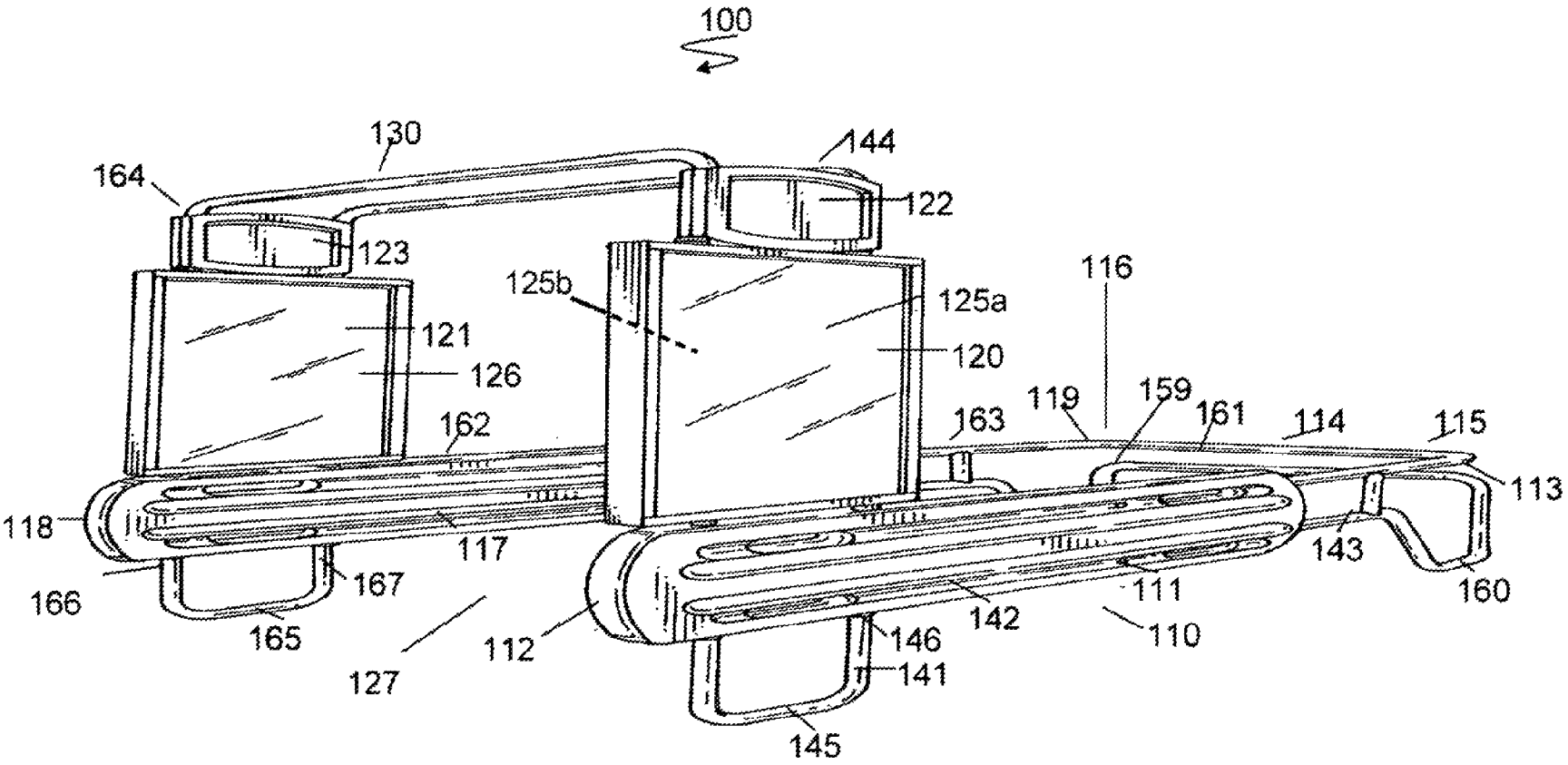
FIG. 1 illustrates a front, side perspective view of a shopping cart corral, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, corral, or apparatus that comprises a list of elements is not necessarily limited to those elements, but may include other elements not expressly listed or inherent to such process, method, system, article, device, corral, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise. Two or more electrical elements may be electrically coupled but not be mechanically or otherwise coupled; two or more mechanical elements may be mechanically coupled, but not be electrically or otherwise coupled;

two or more electrical elements may be mechanically coupled, but not be electrically or otherwise coupled. Coupling may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DETAILED DESCRIPTION OF EXAMPLES OF PREFERRED EMBODIMENTS

Some preferred embodiments disclose a corral configured to hold one or more shopping carts and display one or more advertisements. The corral can include: (a) an enclosure having an opening configured to receive one or more shopping carts, the enclosure having a first side; and (b) at least one first panel located at the first side and configured to display at least a first advertisement of the one or more advertisements.

In some preferred embodiments, advertising panels are coupled adjacent to the opening of the shopping cart corral enclosure. Locating the panels in such a manner improves visibility of the panels when vehicles are parked near the corrals.

In some preferred embodiments, the advertising panels can be configured to hold one or more advertisements that improve the aesthetics of the parking lot and provide visibility in parking lots. Through such increased visibility, customers are able to learn more about products and services of interest, and advertisers are able to make additional commercial impressions in high-trafficked areas. In addition, the shopping cart corrals can be used as a revenue stream for the owners of the parking lots, stores and/or corrals.

Various preferred embodiments disclose an apparatus for retaining two or more shopping carts. The apparatus can include: (a) a first wall with a first end and a second end opposite the first end, the first wall having at least one first advertisement panel configured to display at least one first advertisement; (b) a second wall with a first end and a second end opposite the first end, the first end of the second wall coupled to the second end of the first wall; and (c) a third wall with a first end and a second end opposite the first end, the second end of the third wall coupled to the second end of the second wall. The first wall is spaced apart from the third wall such that two or more shopping carts can be placed between the first wall, the second wall, and the third wall.

A variety of preferred embodiments disclose a method of providing a corral configured to hold one or more shopping carts and display one or more advertisements. The method can include: (a) providing an enclosure having an opening configured to receive one or more shopping carts; (b) providing at least one first panel configured to display at least a first advertisement of the one or more advertisements; and (c) mounting the at least one first panel at a first side of the enclosure.

Figure 2:
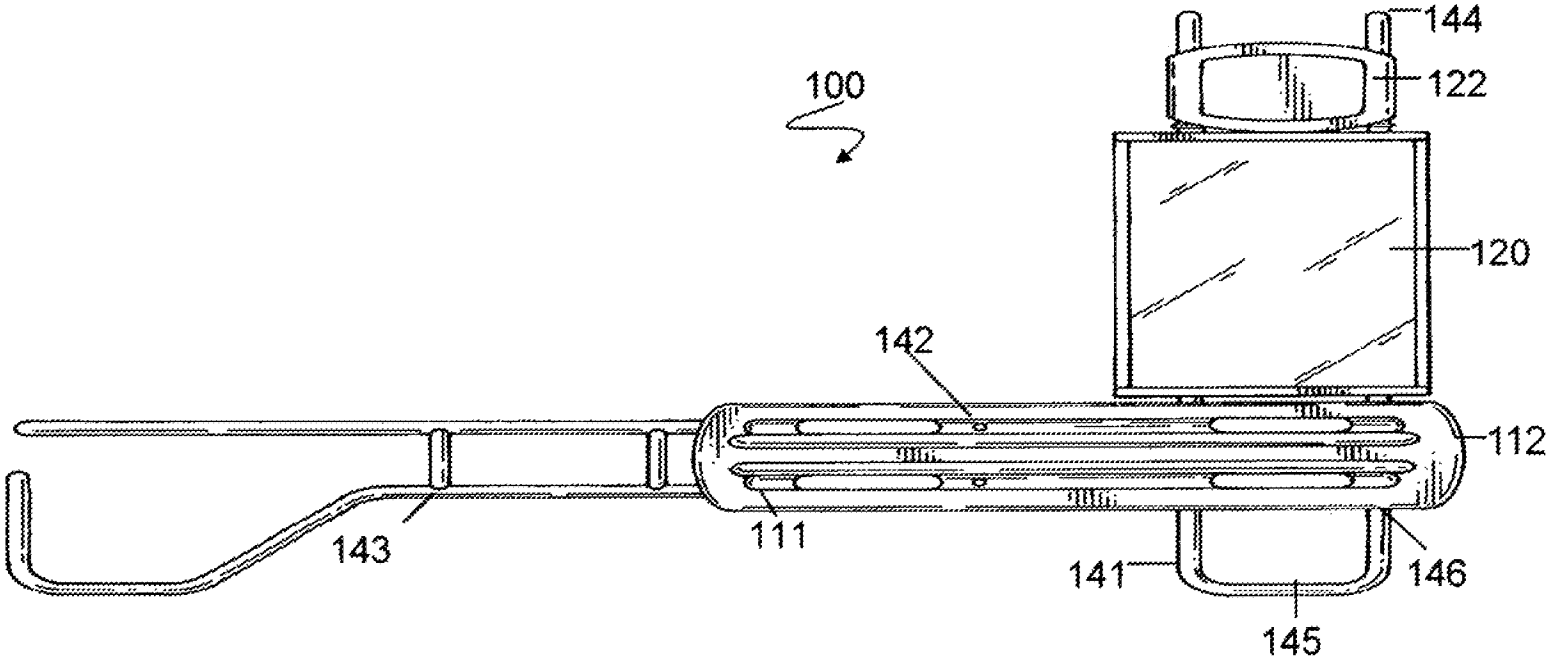
FIG. 2 illustrates a side view of the shopping cart corral of FIG. 1, according to the first embodiment.
Figure 3:
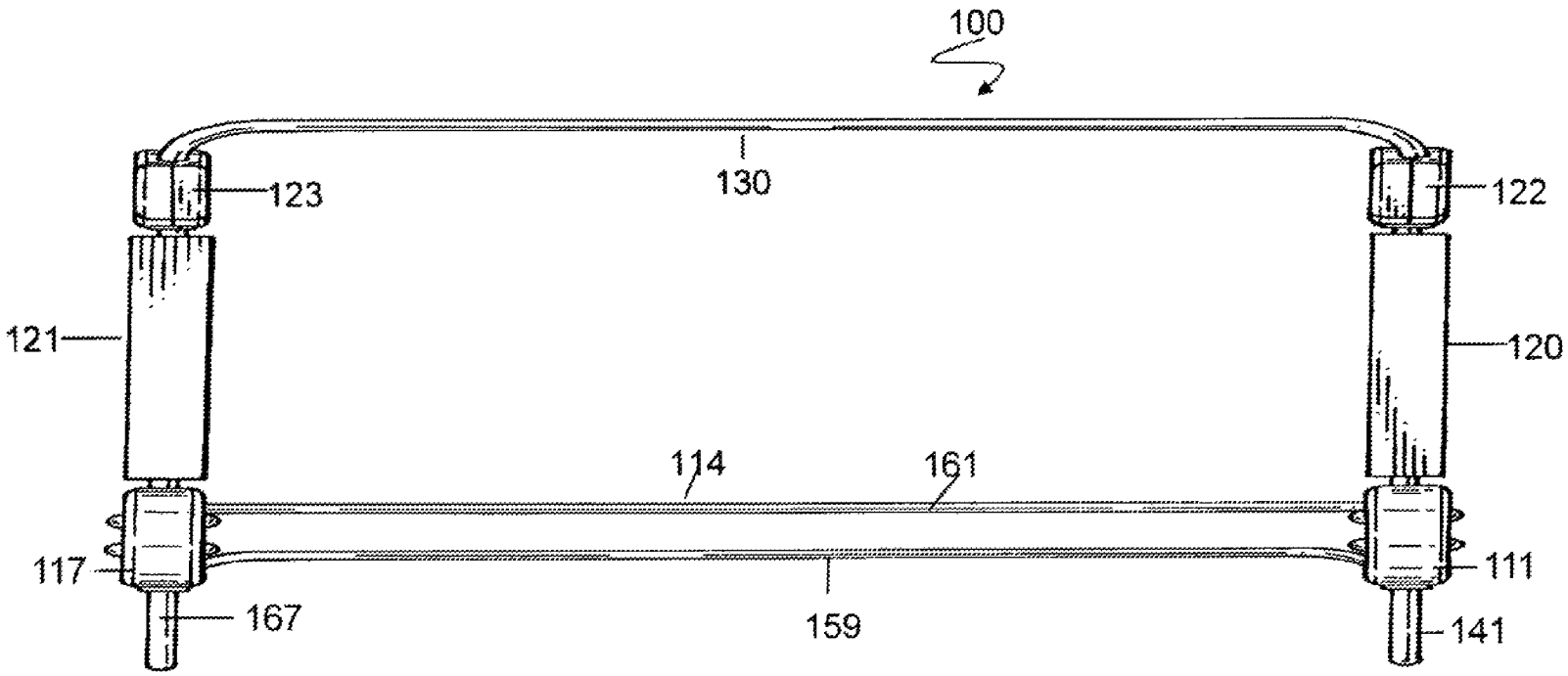
FIG. 3 illustrates a front view of the shopping cart corral of FIG. 1, according to the first embodiment.
Figure 4:
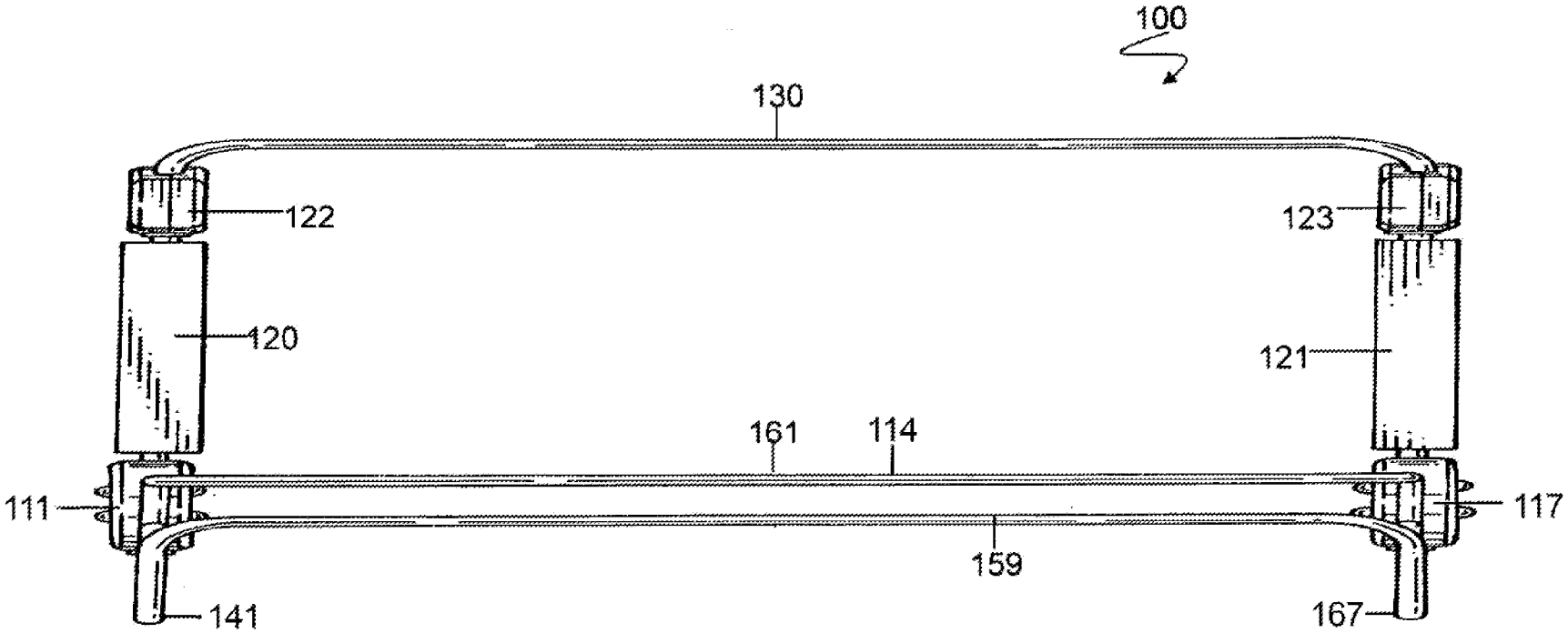
FIG. 4 illustrates a rear view of the shopping cart corral of FIG. 1, according to the first embodiment.
Figure 5:
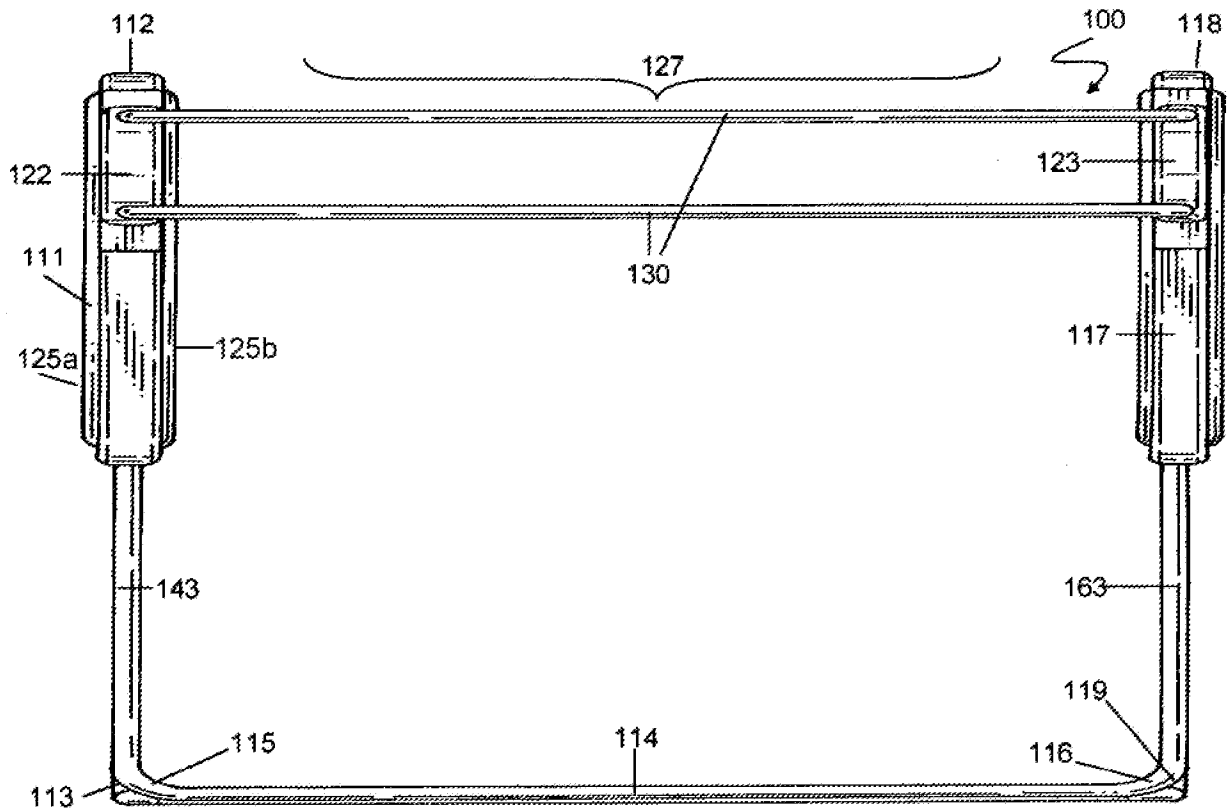
FIG. 5 illustrates a top view of the shopping cart corral of FIG. 1, according to the first embodiment.

Turning to the drawings, FIG. 1 illustrates a front, side perspective view of a shopping cart corral 100, according to a first embodiment of the invention. FIG. 2 illustrates a side view of shopping cart corral 100, according to the first embodiment of the invention. FIG. 3 illustrates a front view of shopping cart corral 100, according to the first embodiment of the invention. FIG. 4 illustrates a rear view of shopping cart corral 100, according to the first embodiment. FIG. 5 illustrates a top view of shopping cart corral 100, according to the first embodiment.

In some examples, shopping cart corral 100 can be configured to hold one or more shopping carts and display one or more advertisements. In the same or different example, shopping cart corral 100 can be considered an apparatus for retaining two or more shopping carts. Shopping cart corral 100 is merely exemplary and is not limited to the embodiments presented herein. Shopping cart corral 100 can be employed in many different embodiments or examples not specifically depicted or described herein.

As illustrated in FIGS. 1-5, shopping cart corral 100 can include: (a) a receptacle and/or enclosure 110; and (b) one or more advertisement panels 120, 121, 122, and 123. Shopping cart corral 100 can be placed in the parking lot of a store to hold shopping carts after customers are finished using the shopping carts.

In various embodiments, enclosure 110 can include: (a) a first side or wall 111 with a first end 112 and a second end 113 opposite first end 112; (b) a second side or wall 114 with a first end 115 and a second end 116 opposite first end 115; (c) a third side or wall 117 with a first end 118 and a second end 119 opposite first end 118; and (d) a roof portion 130. In other examples, enclosure 110 does not include one or more of first wall 111, second wall 114, third wall 117, and roof portion 130.

First wall 111, second wall 114, third wall 117, and roof portion 130 can define enclosure 110. Enclosure 110 can have an interior space defined by the interior surfaces of first wall 111, second wall 114, third wall 117, and roof portions 130. An exterior space can be a space located outside of enclosure 110. Furthermore, enclosure 110 can have an opening 127 configured to receive the one or more shopping carts in the interior space. In some examples, opening 127 can be between first end 112 of first wall 111 and first end 118 of third wall 117.

In some examples, first wall 111 can be coupled to second wall 114. For example, second end 113 of first wall 111 can be coupled to first end 115 of second wall 114. Similarly, second wall 114 can be coupled to third wall 117. For example, second end 116 of second wall 114 can be coupled to second end 119 of third wall 117. Additionally, first wall 111 can be spaced apart from third wall 117 such that two or more shopping carts can be placed between first wall 111, second wall 114, and third wall 117. Roof portion 130 can couple first wall 111 with third wall 117. In some examples, roof portion 130 can provide some additional structure to help increase the strength, stability, and rigidity of enclosure 110.

First wall 111 can include: (a) a leg 141 having a top portion 146 and a bottom portion 145; (b) a barricade section 142 coupled to top portion 146 and advertisement panel 120; and (c) a connector section 143 coupled to barricade section 142 and coupled to first end 115 of second wall 114; and (d) a top portion 144 coupled to roof portion 130 and advertisement panel 122. In some examples, bottom portion 145 can be configured to rest on a surface (such as, for example, the ground, a parking lot surface, etc.) and at least partially support enclosure 110. In other examples, first wall 111 can have other designs or configurations.

Second wall 114 can include connector sections 159 and 161 with one or more bottom portions 160. In some examples, bottom portions 160 can be part of connector section 159 and configured to rest on a surface and at least partially support enclosure 110. In the example illustrated in FIGS. 1-5, each of connector sections 159 and 161 can include a metal or plastic rod coupled to second end 113 of first wall 111 and second end 119 of third wall 117. In other examples, connector section 161 can have other designs or configurations. For examples, connector section 161 could include a barricade section similar to barricade section 142.

Third wall 117 can be identical or substantially similar to first wall 111. For example, third wall 117 can include: (a) a leg 167 having a top portion 166 and a bottom portion 165; (b) a barricade section 162 coupled to top portion 166 and advertisement panel 121; (c) a connector section 163 coupled barrier section 162 and coupled to second end 116 of second wall 114; and (d) a top portion 164 coupled to roof portion 130 and advertisement panel 123. In some examples, bottom portion 165 can be configured to rest on a surface and at least partially support enclosure 110. In other examples, first wall 111 can have other designs or configurations.

In some examples, legs 141 and 167, connector sections 143 and 163, and/or top portions 144 and 164 can be at least partially formed using one or metals, plastics or a combination of metals and plastics. For example, legs 141 and 167, connector sections 143 and 163, and/or top portions 144 and 164 can be formed from steel or aluminum. In the same or different examples, barricade section 143 can be formed using one or more plastics, metals, or a combination of plastics and metal.

Advertisement panel 120 can be coupled to advertisement panel 122 in some examples. Furthermore, advertisement panel 121 can be coupled to advertisement panel 123. In some example, advertisement panels 120, 121, 122, and 123 can be considered a part of or integrally formed with enclosure 110. In other examples, advertisement panels 120, 121, 122, and 123 are separable but coupleable to enclosure 110.

Each of advertisement panels 120, 121, 122, and 123 can be configured to display one or more advertisements. In some embodiments, advertisement panels 120, 121, 122, and 123 can display print advertisements. For example, advertisement panels 120 and 121 could display one or more 3 foot by 4 foot posters or one or more four foot by 6 foot poster. Advertisement panels 122 and 123 could display smaller posters in some examples. For example, advertisement panels 122 and 123 could display one or more 1 foot by 1½ foot posters.

In some preferred embodiments, the owner of the store, parking lot and/or shopping corral can use shopping cart corral 100 as a revenue stream. For example, one or more advertisement panels 120, 121, 122 and 123 can be leased to an advertiser. By leasing one or more advertisement panels 120, 121, 122 and 123 for displaying advertisements, an advertiser can make a commercial impression on a wide variety of pedestrian and vehicular traffic through the parking lot.

In some embodiments, the advertisements displayed in panels 120, 121, 122 and 123 can be aesthetically pleasing (i.e., colorful, eye-catching, artistic, etc.) and can improve the overall appearance of the parking lot. As a result, advertising panels 120, 121, 122 and 123 can facilitate attracting additional customers and traffic to the parking lot and/or store.

Advertising panels 120, 121, 122 and 123 can be configured in any shape and/or size. For example in one embodiment, not shown, advertising panels 120 and 121 are configured to have a width approximately equal to the lengths of barricade sections 142, 162. In other embodiments, advertising panels 120, 121, 122 and 123 are configured to be circular, oval-shaped, triangular, as a parallelogram, and/or in any other shapes or sizes.

One or more advertisement panels 120, 121, can be coupled adjacent to first end 112 of first wall 111 and first end 118 of third wall 117. For example, advertising panel 120 can be coupled adjacent to first end 112 of first wall 111 and advertising panel 121 can be coupled adjacent to first end 118 of third wall 117. Further, advertising panels 122 and 123 can be coupled on top of advertisement panels 120, and 121, such that advertisement panels 122 and 123 are located towards opening 127. In one embodiment, one or more advertisement panels 120, 121 are coupled adjacent to first end 112 of first wall 111 and first end 118 of third wall 117, such that when a vehicle is parked next to corral 100, the vehicle does not block and/or only partially blocks advertisement panels 120, 121, 122 and 123. The coupling of one or more advertising panels 120, 121, 122 and 123 near opening 127 can facilitate better viewing of advertising panels 120, 121, 122 and 123. Such better viewing of advertising panels 120, 121, 122 and 123 can improve the aesthetics of a parking lot. While coupling advertising panels 120, 121, 122 and 123 near opening 127 is described in detail for exemplary corral 100, advertising panels can be similarly coupled near the opening of other types and configurations of corrals.

Moreover, one or more advertising panels 120, 121, 122 and 123 can be coupled to any other portions of a corral as well. For example, in another embodiment, not shown, one or more advertising panels 120, 121, 122 and 123 can be coupled adjacent to first end 115 of second wall 114 and/or second end 116 of second wall 114. For example, advertising panel 120 can be coupled adjacent to first end 115 of second wall 114 and advertising panel 121 can be coupled adjacent to second end 116 of second wall 114.

The owner of shopping cart corral 100 can sell the right to place advertisement in advertisement panels 120, 121, 122, and/or 123. Thus, shopping cart corral 100 can produce revenue for the store and/or owner of the corral or advertising space. Furthermore, the addition of advertisement panels 120, 121, 122, and 123 provide an unexpected benefit over existing shopping cart corrals. In some examples, the advertisements in advertisement panels 120, 121, 122, and/or 123 will be routinely updated or changed. Accordingly, shopping cart corral 100 will not be an eyesore or a blemish in the parking lot of the store. The changing advertisement will give shopping cart corral 100 a vibrant, updated, fresh look, not found in existing shopping cart corrals.

In the same or different embodiments, advertisement panels 120, 121, 122, and 123 can each display two or more advertisements. For example, the at least one advertisement panels 120, 121, 122, and 123 can be configured to hold an advertisement such that the advertisement is visible from a space exterior to the receptacle. That is, for example, advertisement panel 120 can include at least one display 125(*a*) located at the exterior surface of first wall 111 and at least one display 125(*b*) located at the interior surface of first wall 111. In some embodiments displays 125(*a*) and 125(*b*) can include a backing board (e.g., corkboard) surrounded by a metal or plastic frame with a clear plastic or glass cover. The advertisement(s) in displays 125(*a*) and/or 125(*b*) can be viewed through the clear plastic or glass cover. In other embodiments, advertisement panel 120 can include a frame with a clear cover on both the interior and exterior surface. In yet another embodiment, a two-sided advertisement can be placed in advertisement panel 120 and viewed from both the interior and exterior of enclosure 110.

Similarly, in some examples, advertisement panels 121, 122, and/or 123 can include at least one display located at the exterior surface of enclosure 110 and at least one display located at the interior surface of enclosure 110, such as 126 of panel 121. In other examples, advertisement panels 122 and 123 include a sign signaling to customers to return their shopping carts to shopping cart corral 100. For example, advertisement panels 122 and 123 can be made from a plastic and include a picture of a shopping cart.

In other examples, advertisement panels 120, 121, 122, and 123 can display electronic and/or multimedia advertisements. For example, one or more of advertisement panels 120, 121, 122, and 123 can include an electronic display configured to display video, electronic images, and/or audio-video advertisements. In yet other examples, one or more of advertisement panels 120, 121, 122, and 123 can include interactive or dynamic advertisements that allow potential customers to interact with the advertisement. For example, advertisement panels 120 could include an electronic advertisement on a screen asking the potential customer to touch a button or the screen to receive a discount on a product (e.g., a coupon). When the user touches the button or the screen, a printer attached to the screen could print the user a coupon or direct the user to go to a location in the adjacent store to receive the product discount.

Figure 6:
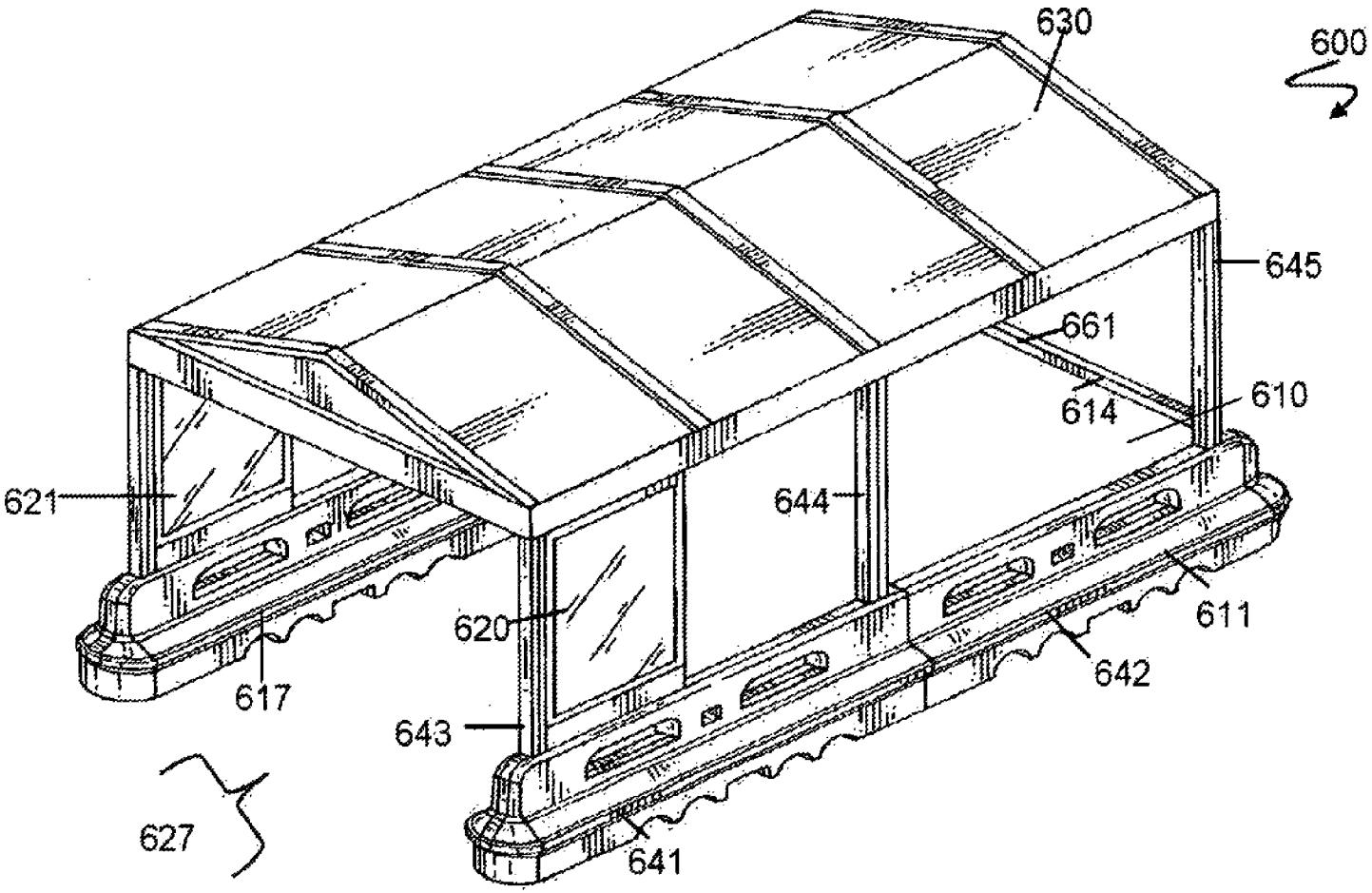
FIG. 6 illustrates a front, side, top perspective view of a shopping cart corral, according to a second embodiment.
Figure 7:
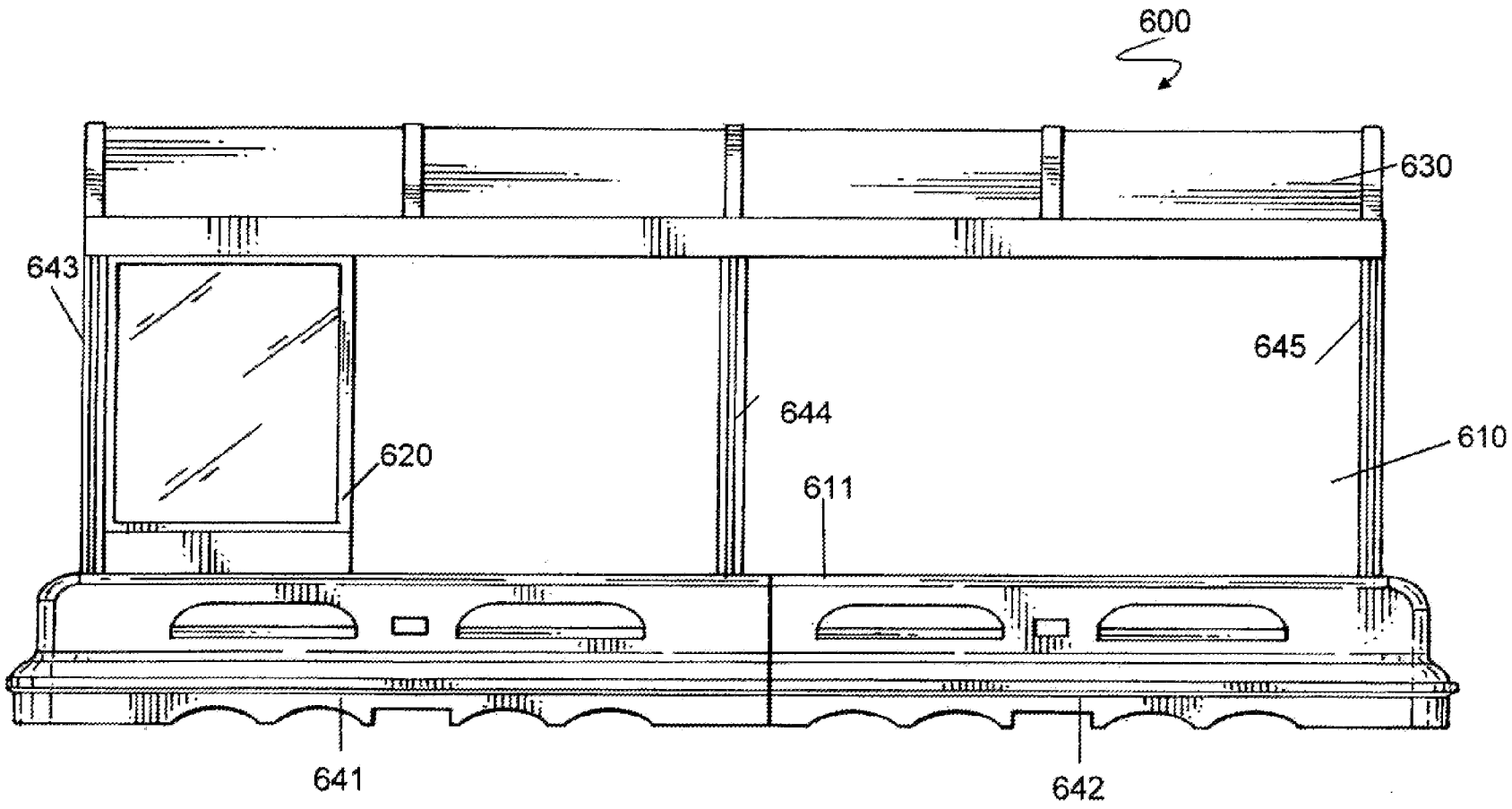
FIG. 7 illustrates a side view of the shopping cart corral of FIG. 6, according to the second embodiment.
Figure 8:
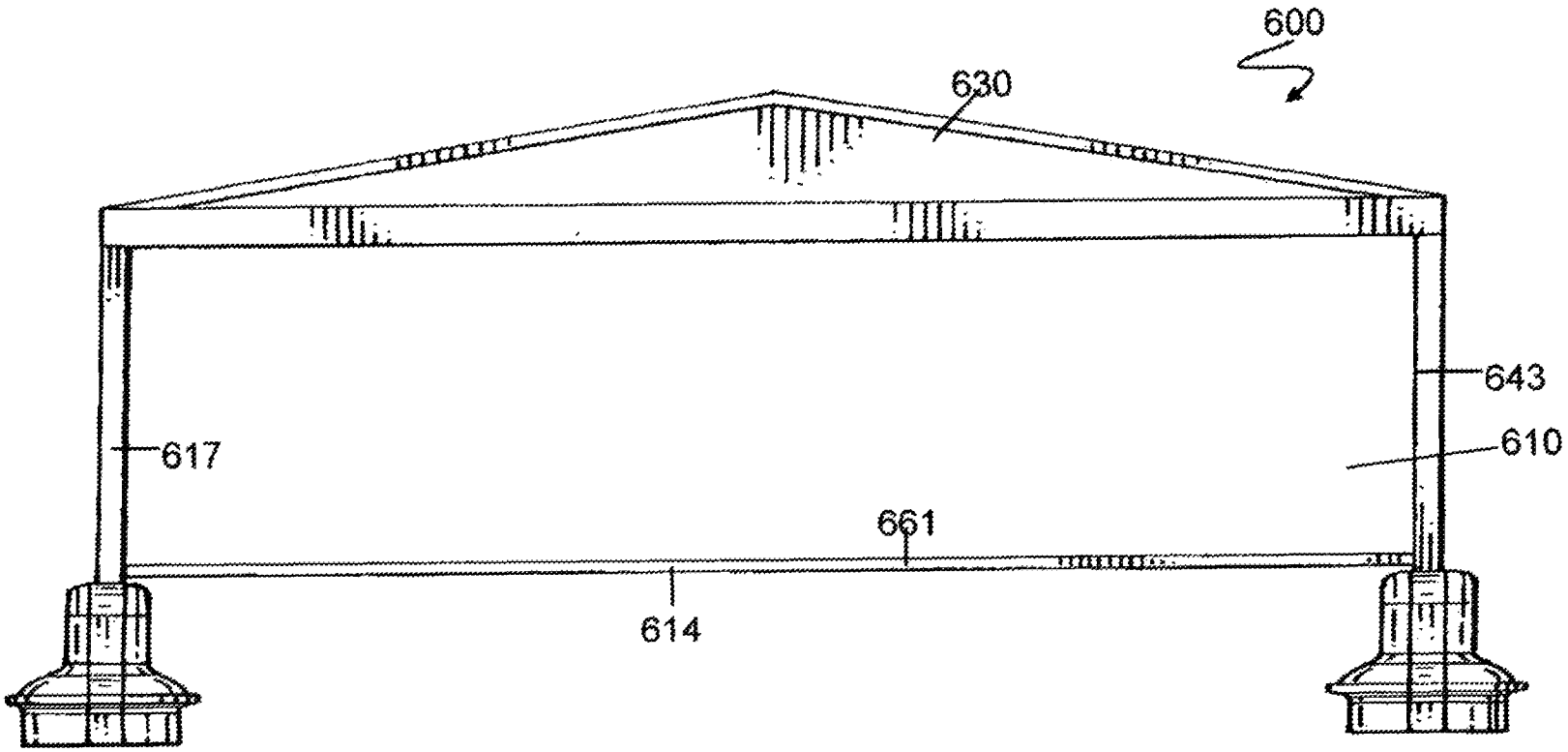
FIG. 8 illustrates a front view of the shopping cart corral of FIG. 6, according to the second embodiment.
Figure 9:
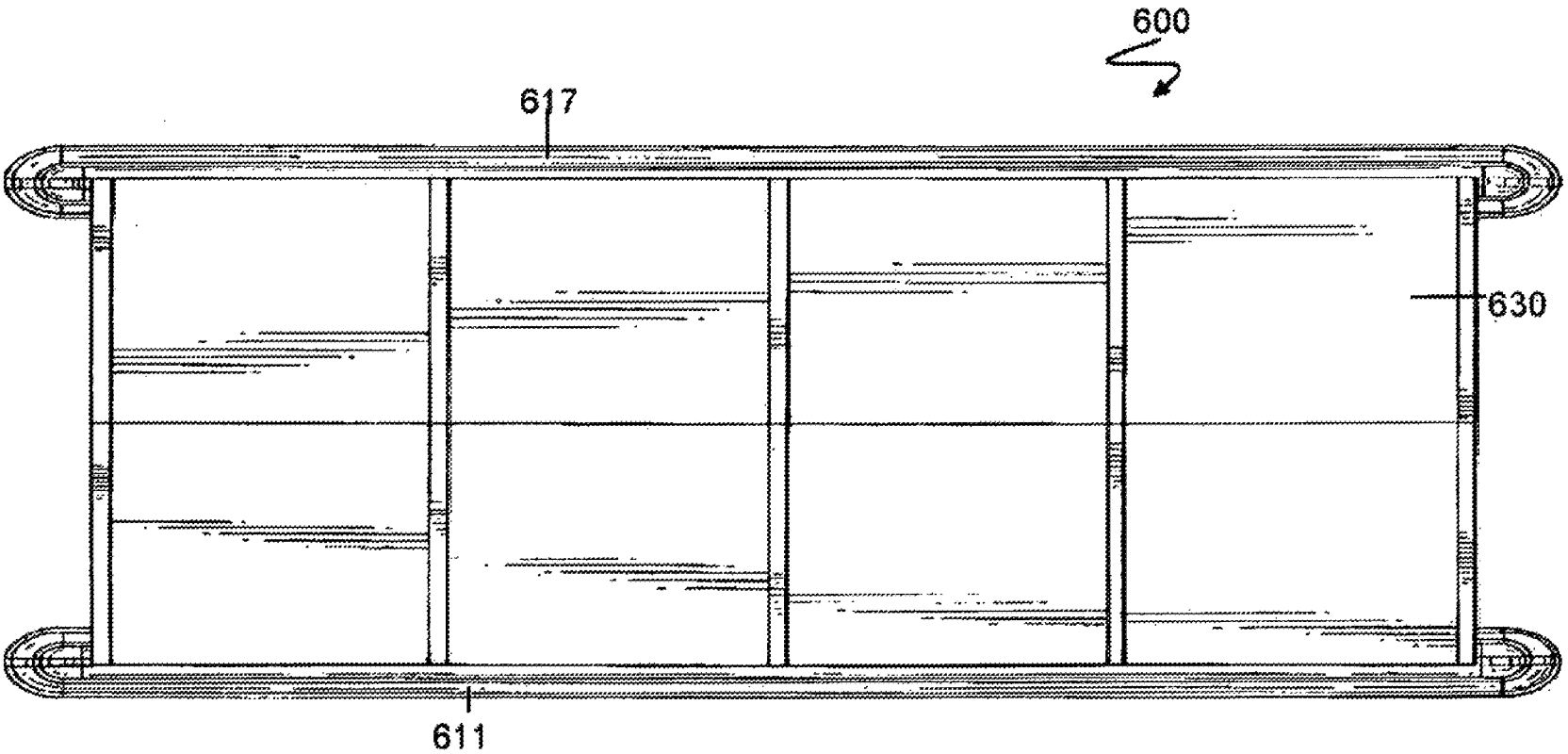
FIG. 9 illustrates a top view of the shopping cart corral of FIG. 6, according to the second embodiment.

Turning to additional embodiments, FIG. 6 illustrates a front, side, top perspective view of a shopping cart corral 600, according to a second embodiment. FIG. 7 illustrates a side view of shopping cart corral 600, according to the second embodiment. FIG. 8 illustrates a front view of shopping cart corral 600, according to the second embodiment. FIG. 9 illustrates a top view of shopping cart corral 600, according to the second embodiment.

As illustrated in FIGS. 6-9, shopping cart corral 600 can include: (a) a receptacle and/or enclosure 610; and (b) one or more advertisement panels 620 and 621 configured to display advertisements. In some examples, advertisement panels 620 and 621 can be similar to advertisement panels 120, 121, 122, and/or 123.

In various embodiments, enclosure 610 can include: (a) a first side or wall 611; (b) a second side or wall 614 coupled to first wall 611; (c) a third side or wall 617 coupled to second wall 614 and spaced apart from first wall 611 such that an opening 627 exists between first wall 611 and third wall 617; and (d) a roof or roof portion 630 coupled to first wall 611, second wall 614, and third wall 617. In these examples, roof portion 630 covers an interior portion of enclosure 610.

First wall 611 can include: (a) one or more barriers 641 and 642, with barriers 641 and 642 configured to rest on a surface; (b) one or more extension portions 643, 644, and 645 coupled to roof portion 630. In some examples, advertisement panel 620 can be coupled to barrier 641 or roof portion 630 and extension portion 643 or extension portion 644. In other examples, advertisement panel 620 can be coupled to barrier 642 or roof portion 630 and/or extension portions 644 and 645.

Barrier portions 641 and 642 can be formed from concrete or plastics in some examples. Extension portions 643, 644, and 645 can be formed from plastic or metals in the same or different examples.

In some embodiments, third wall 617 can be similar or identical to first wall 611. Advertisement panel 621 can be coupled to third wall 617. Second wall 614 can include a connector section 661 in the same or different embodiments.

Figure 10:
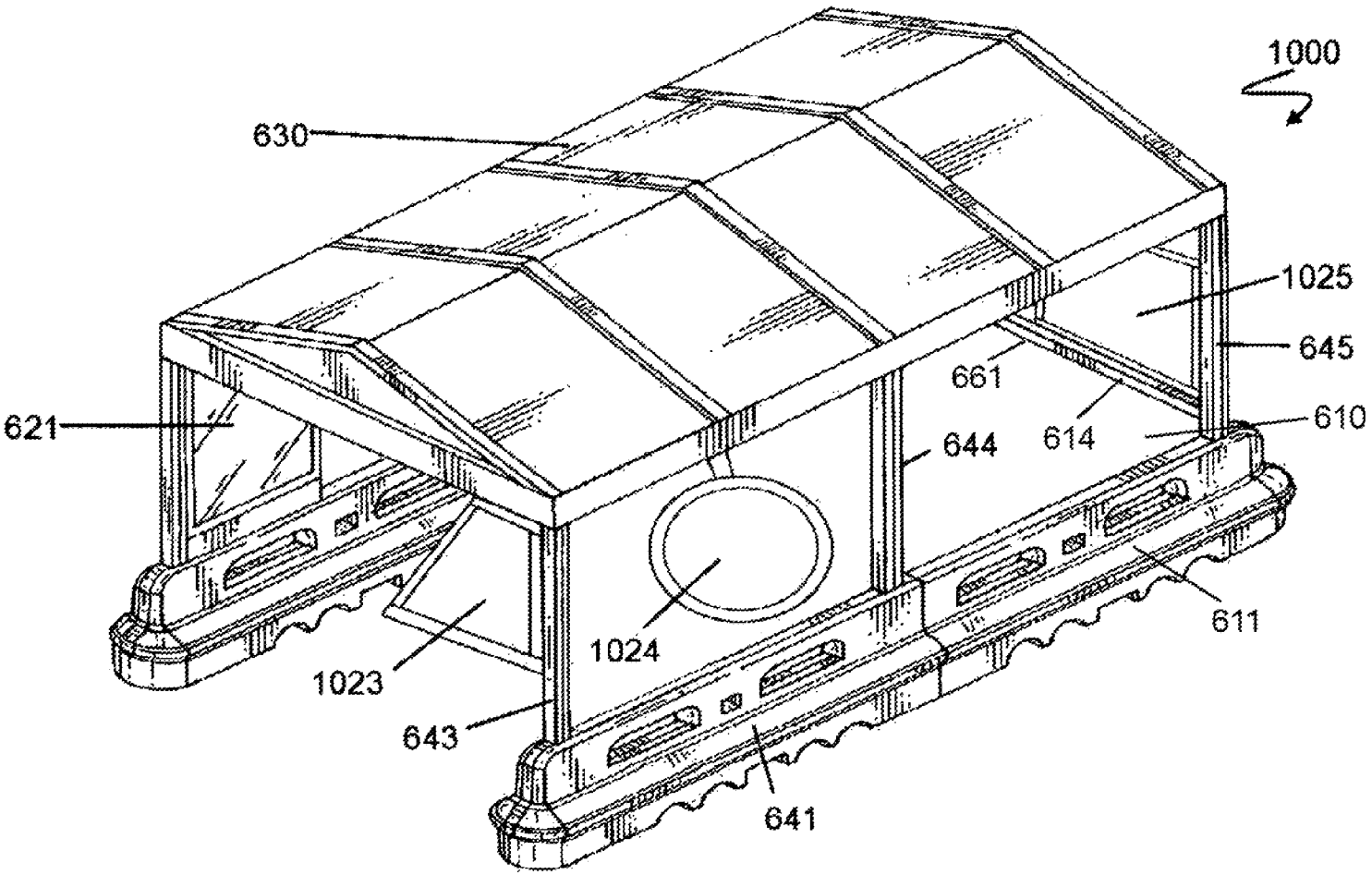
FIG. 10 illustrates a front, side, top perspective view of a shopping cart corral, according to a third embodiment.

Turning to yet other embodiments, FIG. 10 illustrates a front, side, top perspective view of a shopping cart corral 1000, according to a third embodiment. As illustrated in FIG. 10, shopping cart corral 1000 can include: (a) a receptacle and/or enclosure 610; and (b) advertisement panels 621, 1023, 1024, and 1025 configured to display advertisements. Advertisement panels 1023, 621, 1024 and 1025 can be configured to be any shape and/or size. Advertisement panels 1023, 621, 1024 and 1025 can be configured to be coupled to any portion of shopping cart corral 1000. In some examples, advertisement panel 1023 can be coupled to roof portion 630 and extension portion 643. Advertisement panel 1024 can be coupled to roof portion 630 and barrier 641 or to barrier 641 and extension portion 643 and/or 644. Advertisement panel 1025 can be coupled to connector section 661 and extension portion 645 or roof portion 630.

Figure 11:
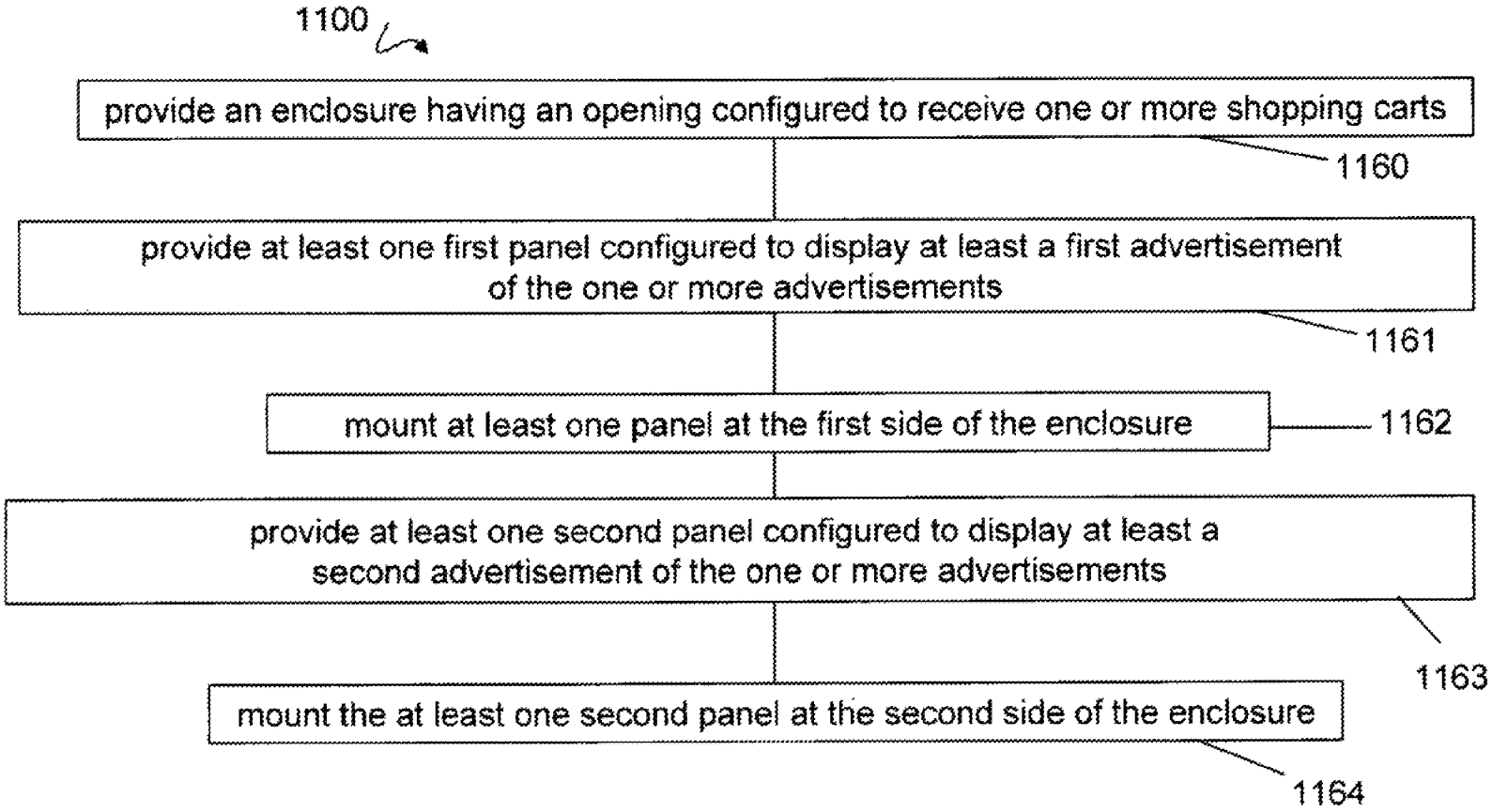
FIG. 11 illustrates a flow chart of a method of providing a corral configured to hold one or more shopping cart and display one or more advertisements, according to the first embodiment.

FIG. 11 illustrates a flow chart of a method 1100 of providing a corral configured to hold one or more shopping cart and display one or more advertisements, according to the first embodiment.

Method 1100 includes an activity 1160 of providing an enclosure having an opening configured to receive the one or more shopping carts. As an example, the enclosure can be identical or similar to enclosure 110 or 610 of FIGS. 1 and 6, respectively. The opening in the enclosure can be similar or identical to opening 127 or 627 of FIGS. 1 and 6, respectively.

Figure 12:
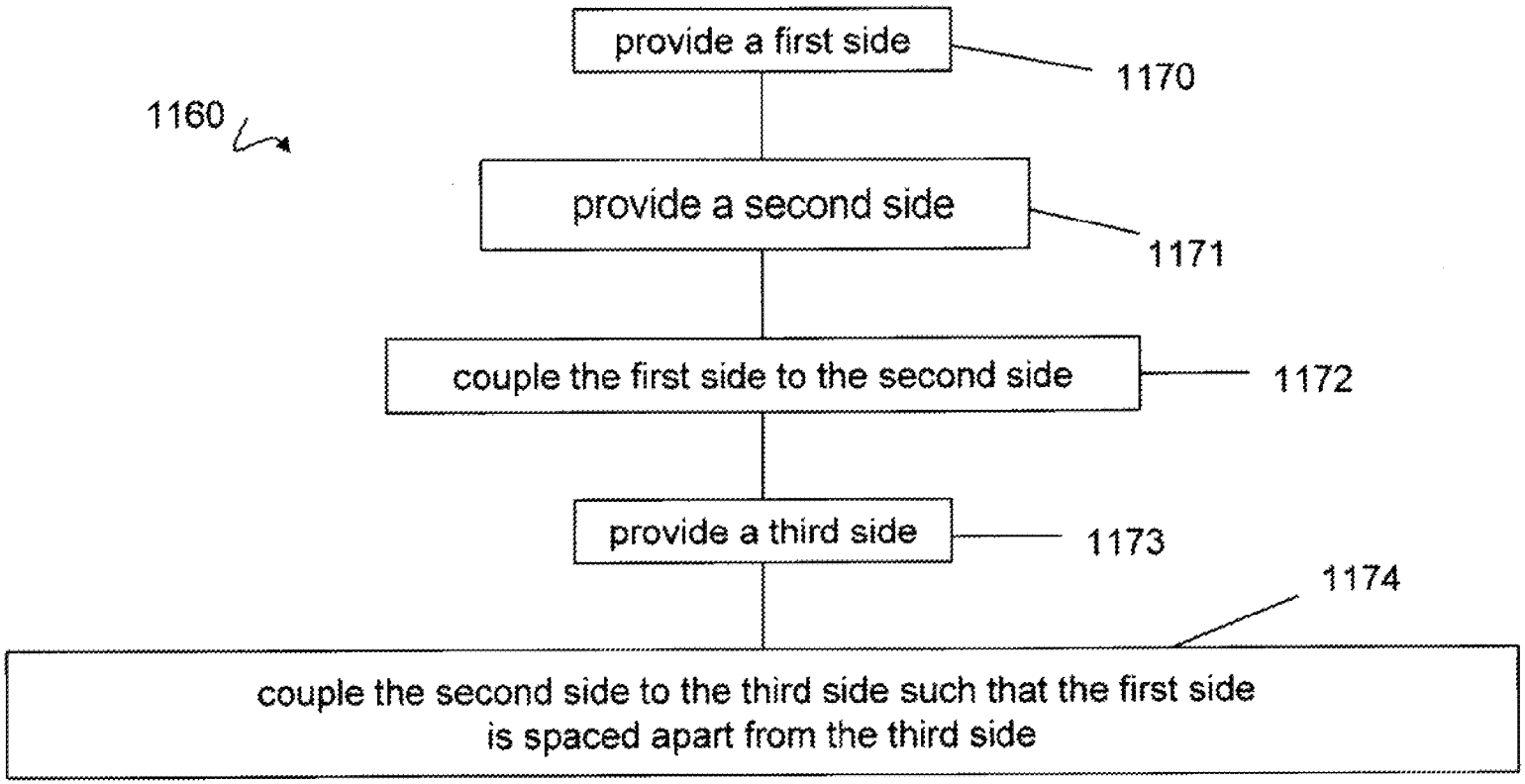
FIG. 12 illustrates a flow chart of an activity of providing an enclosure, according to the first embodiment.

FIG. 12 illustrates a flow chart of activity 1160 of providing the enclosure, according to the first embodiment. Activity 1160 in FIG. 12 includes a procedure 1170 of providing a first side. As an example, the first side can be similar or identical to first wall 111 or 611 of FIGS. 1 and 6, respectively.

Subsequent activity 1160 in FIG. 12 can include a procedure 1171 of providing a second side. As an example, the second side can be similar or identical to second wall 114 or 614 of FIGS. 1 and 6, respectively.

Activity 1160 in FIG. 12 can continue with a procedure 1172 of coupling the first side to the second side. As an example, the first side can be coupled to the second side similar or identical to the coupling of first wall 111 to second wall 114, as illustrated in FIG. 1. In another example, the first side can be coupled to the second side similar or identical to the coupling of first wall 611 to second wall 614, as illustrated in FIG. 6.

Next, activity 1160 in FIG. 12 can include a procedure 1173 of providing a third side. As an example, the third side can be similar or identical to third wall 117 or 617 of FIGS. 1 and 6, respectively.

Activity 1160 in FIG. 12 can continue with a procedure 1174 of coupling the second side to the third side such that the first side is spaced apart from the third side. As an example, the second side can be coupled to the third side similar or identical to the coupling of second wall 114 to third wall 117, as illustrated in FIG. 1. In another example, the second side can be coupled to the third side similar or identical to the coupling of second wall 614 to third wall 617, as illustrated in FIG. 6. After procedure 1174, activity 1160 is complete.

Referring back to FIG. 11, method 1100 in FIG. 11 continues with an activity 1161 of providing at least one first panel configured to display at least a first advertisement of the one or more advertisements. As an example, the at least one first panel can be similar or identical to advertisement panel 120, 121, 122 or 123 of FIG. 1, advertisement panel 620 or 621 of FIG. 6, or advertisement panel 621, 1023, 1024, or 1025 of FIG. 10.

Subsequently, method 1100 includes an activity 1162 of mounting the at least one first panel at a first side of the enclosure. As an example, the at least one first panel can be mounted at a first side of the enclosure similar or identical to the mounting of advertisement panel 120 at first wall 111 of enclosure 110 as illustrated in FIG. 1. In another example, the at least one first panel can be mounted at the first side of the enclosure similar or identical to the mounting of advertisement panel 620 at first wall 611 of enclosure 610 as illustrated in FIG. 6. In still another example, the at least one first panel can be mounted at the first side of the enclosure similar or identical to the mounting of advertisement panel 1024 at first wall 611 of enclosure 610 as illustrated in FIG. 10.

Next, method 1100 includes an activity 1163 of providing at least one second panel configured to display at least a second advertisement of the one or more advertisements. As an example, the at least one first panel can be similar or identical to advertisement panel 120, 121, 122, or 123 of FIG. 1, advertisement panels 620 or 621 of FIG. 6, or advertisement panels 621, 1023, 1024, or 1025 of FIG. 10.

Method 1100 in FIG. 11 continues with an activity 1164 of mounting the at least one second panel at the second side of the enclosure. As an example, the at least one second panel can be mounted at the second side of the enclosure similar or identical to the mounting of advertisement panel 121 or 123 at third wall 117 of enclosure 110 as illustrated in FIG. 1. In another example, the at least one second panel can be mounted at the second side of the enclosure similar or identical to the mounting of advertisement panel 621 at third wall 617 of enclosure 610 as illustrated in FIG. 6. In yet another example, the at least one second panel can be mounted at the second side of the enclosure similar or identical to the mounting of advertisement panel 1025 at second wall 614 of enclosure 610 as illustrated in FIG. 10.

Although the invention has been described with reference to specific embodiments, it will be understood by those skilled in the art that various changes may be made without departing from the spirit or scope of the invention. For example, it will be readily apparent that enclosure 110 or 610 can have various designs, components, portions, and/or shapes, not shown in FIGS. 1-10. Additional examples of such changes have been given in the foregoing description. Accordingly, the disclosure of embodiments is to be illustrative of the scope of the invention and is not intended to be limiting. It is intended that the scope of the invention shall be limited only to the extent required by the appended claims. To one of ordinary skill in the art, it will be readily apparent that the shopping cart corral, the apparatus and method of providing discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A corral for retaining two or more shopping carts, the corral comprising:

a first wall with a first end and a second end opposite the first end;

a second wall with a first end and a second end opposite the first end, the first end of the second wall coupled to the second end of the first wall;

a third wall with a first end and a second end opposite the first end, the second end of the third wall coupled to the second end of the second wall, the third wall opposite the first wall, wherein the first wall is spaced apart from the third wall such that the two or more shopping carts can be placed between the first wall and the third wall;

at least one first panel located above and separate from the first wall and at least one second panel located above and separate from the third wall;

a member coupled to, and extending through, the at least one first panel and the at least one second panel so as to further couple the first wall with the third wall; and at least one advertisement coupled to the member above the first or third wall.

2. The corral of claim 1, wherein the member comprises a top portion that extends above the at least one first panel and at least one second panel.

3. The corral of claim 2, wherein the top portion comprises a first metal member and a second metal member that are substantially parallel to each other.

4. The corral of claim 1, wherein the first wall and the third wall comprise barricade sections formed of plastic.

5. The corral of claim 4, wherein the member is coupled to, and extends through, the barricade sections of the first and third walls.

6. The corral of claim 5, wherein the member includes two bottom portions that extend below the barricade sections, each one of the bottom portions being configured to rest on a ground surface and at least partially support the corral.

7. The corral of claim 1, wherein the at least one advertisement is associated with a business located in a vicinity of the corral.

8. The corral of claim 1, wherein the at least one advertisement comprises a first advertisement that is coupled to the member above the first wall and a second advertisement that is coupled to the member above the third wall.

9. The corral of claim 1, wherein the member forms an integral assembly with the first and third walls and the at least one first and second panels.

10. The corral of claim 1, wherein the bar member is substantially parallel to the second wall.

11. A corral configured to hold one or more shopping carts, the corral comprising:

an enclosure having an opening configured to receive the one or more shopping carts;

a first structure, a second structure, and a third structure, wherein the second structure is coupled to the first structure, and the third structure is coupled to the second structure so as to be spaced apart from the first structure, the enclosure being defined by the first, second and third structures;

a bar member;

at least one first panel located above and separate from the first structure near the opening of the enclosure;

at least one second panel located above and separate from the third structure near the opening of the enclosure;

wherein the bar member is coupled to, and extends through, the at least one first panel and the at least one second panel so as to further couple the first structure with the third structure near the opening of the enclosure; and at least one advertisement coupled to the bar member.

12. The corral of claim 11, wherein the bar member comprises a top portion that extends above the at least one first panel and at least one second panel.

13. The corral of claim 12, wherein the top portion comprises a first metal member and a second metal member that are substantially parallel to each other.

14. The corral of claim 11, wherein the first structure and the third structure comprise barricade sections formed of plastic.

15. The corral of claim 14, wherein the bar member is coupled to, and extends through, the barricade sections of the first and third structures.

16. The corral of claim 15, wherein the bar member includes two bottom portions that extend below the barricade sections, each one of the bottom portions being configured to rest on a ground surface and at least partially support the corral.

17. The corral of claim 11, wherein the at least one advertisement is associated with a business located in a vicinity of the corral.

18. The corral of claim 11, wherein the at least one advertisement comprises a first advertisement that is coupled to the bar member above the first structure and a second advertisement that is coupled to the bar member above the third structure.

19. The corral of claim 11, wherein the bar member forms an integral assembly with the first and third structures and the at least one first and second panels.

20. The corral of claim 11, wherein the bar member is substantially parallel to the second structure.

* * * * *